US005294122A

United States Patent [19]

Longo

[11] Patent Number: 5,294,122

[45] Date of Patent: Mar. 15, 1994

[54] GOLF PUTTER

[76] Inventor: Paul F. Longo, 41-295 Woodhaven Dr., Palm Desert, Calif. 92260

[21] Appl. No.: 981,429

[22] Filed: Nov. 25, 1992

[51] Int. Cl.[5] ..... A63B 53/04

[52] U.S. Cl. ..... 273/162 E; 273/167 B; 273/167 A; 273/80 C

[58] Field of Search ..... 273/167 A, 167 B, 167 D, 273/167 F, 167 J, 167 H, 168, 174, 162 E; D21/217, 218, 219, 220

[56] References Cited

U.S. PATENT DOCUMENTS 3,240,497 3/1966 Taylor ..... 273/174 X
3,486,755 12/1969 Hodge ..... 273/167 A
3,779,398 12/1973 Hunter ..... 273/162 E X

*Primary Examiner*—George J. Marlo
*Attorney, Agent, or Firm*—I. Louis Wolk

[57] ABSTRACT

A golf putter having a head designed to function effectively, both on the green, on the fringe thereof as well as in the higher grass areas, which comprises a rectangular body with a flat base which helps prevent "heel high-toe high" formed with comb-like longitudinal ridges or runners which serve to part grass blades during forward and backward movement and provided with a horizontal upwardly positioned ball striking surface and a downwardly tapered top surface having a ball pick-up socket at its rear edge.

7 Claims, 1 Drawing Sheet

GOLF PUTTER

BACKGROUND OF THE INVENTION

The present invention relates to a novel golf putter which is distinguished by the design of a putting head which is particularly useful in the fringe or longer grass area which usually surrounds the putting surface of the green. In addition it is equally useful upon the normal putting surface itself.

In the past, very little attention has been directed toward the solution to the above mentioned problem which exists with respect to putting from the fringe area. One attempt at such a solution is described in U.S. Pat. No. 4,529,202 in which a putter is designed with an elevated putting face raised from the putting surface, and supported between a pair of circular or semi-circular discs. The only contact with the putting surface is by means of these discs. While such a design may have some efficiency in avoiding problems with the higher grass height of fringe areas it has the disadvantage that the disc members fail to provide a suitable contact surface with the green or fringe requiring an exact angular position of the club head during the putting stroke. Because of the curved surface paralleled to the green such a position is difficult if not impossible to attain, resulting in failure to properly engage the golf ball when stroked.

The problems encountered in attempting to putt from the fringe or higher grass areas surrounding a green are correctly set forth in the specification of the above patent. As described further below applicant has designed a novel putter head which effectively resolves these problems. At the same time the putter head described herein is fully effective upon the normal putting green surface.

SUMMARY OF THE INVENTION

The invention as described in the following detailed description and drawings and as defined in the claims, shows applicants novel putter head with a shaft thereon mounted in an angular position to the players hand as described below. The putter head itself is provided with a flat planar base having spaced parallel longitudinal grooves formed therein extending in the direction of movement of the putter head in play. The head is designed with a flat lie and an elevated upthrust narrow putting face which is formed and dimensioned so as to engage the ball, at movement. The top of the head is tapered downward toward the rear to prevent the grass from grabbing the top surf ace during forward movement. The grooves in the base are spaced and dimensioned to form a plurality of spaced parallel runners which allow the head to move through the grass in both forward and backward direction by providing a sled effect.

The top face of the head is provided with an open slot centered at its rear edge to act as a pick-up receptacle for the ball as well as with a front centered directional indicator and several spaced forwardly directed grooves or markers to assist in a visual alignment of the head when putting.

The foregoing summary has described in broad terms some of the important features of the present invention in order that the detailed description which follows may be better understood. Additional features and more specific details are described hereinafter which form the subject of the invention as claimed.

DETAILED DESCRIPTION OF THE INVENTION

Figure 1:
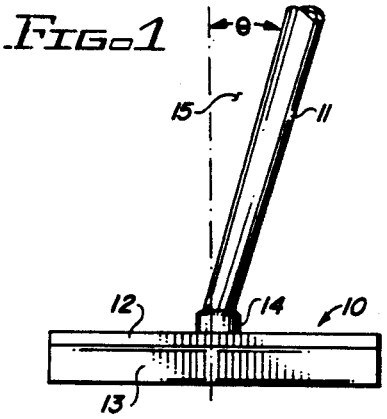
FIG. 1 is a front view in perspective showing the club head positioned in striking position with the shaft at an angle to the vertical and toward the player.

As shown in FIG. 1, club head 10 is shown with shaft 11 mounted in socket 14. The end of the shaft is bent at a preferred angle at its end which fits into the socket to provide an angle 15 to the vertical, preferably in the range of 18–24 degrees. This places the shaft as shown in alignment with the putting face and the player at an angle to the vertical as referred to above. The relatively narrow putting face to the head is shown at 12 formed along the front upper edge of the head coextensive with the wider upthrust front section 13 tapering upward at an angle of about 45 degrees from the base as described further below.

Figure 2:
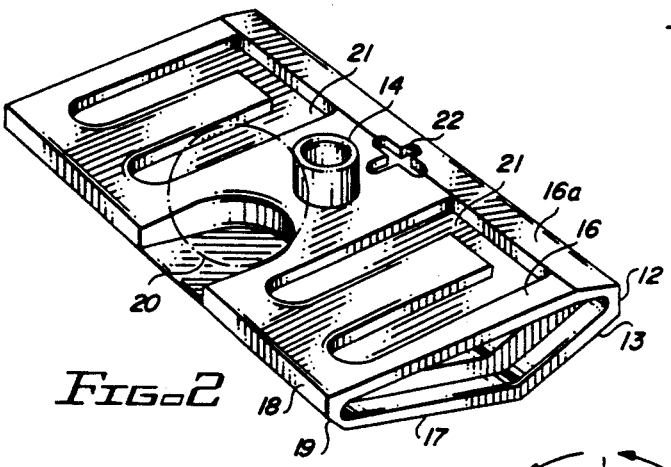
FIG. 2 is a top elevational view of the putter head showing one side edge and upper face.

In FIG. 2 the club head is shown in perspective in an isometric view showing the top and side edges. The club head is compact in its overall dimensions. In a preferred size, as illustrated, the head is rectangular in shape say about 3¾" front and back and 2¼"at the sides. It may be formed of any suitable material, i.e. cast bronze or steel, or even molded plastic or graphite weighted with dispersed metal particles.

As shown in FIGS. 2–6 the top surface 16 tapers downward from a narrow flattened front area **16*a* at a shallow angle, say about 13 degrees to a narrow rear edge 18 which in turn tapers downward as shown at 19 to the bottom surface of the head at 17. The result is a head which is relatively shallow with a depth or thickness at its greatest point of about ¾" which includes the relatively narrow striking face 12 of about ¼" and the rear edge 18 which may be about ⅛". The flattened area at the bottom edge and the taper at the rear edge cooperate to minimize the functional effects of engagement with grass at the fringe area during back and forth movement of the club head. The top surface includes also the socket 14 for reception of the shaft which is positioned about ¾" from the face, giving a full view of the ball. As shown in FIG. 1 the end of the shaft is bent to a suitable angle say in the range of 18–24 degrees as mentioned above. And a recessed area or pocket 20 is open at the rear edge with a diameter of about ¾" to allow a ball to be scooped from the ground and lifted up with the club head to eliminate stooping. Also shown are several spaced recesses 21 which provide linear and transverse markings to assist in proper alignment along with a smaller similar marker 21** in the form of a cross indentation. These recesses may be coated or filled with a pigment of contrasting color, i.e. black, to facilitate eye alignment of club head and ball with the cup on the green.

Figure 3:
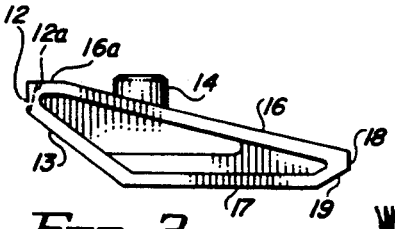
FIG. 3 is a side-edge view of the head.
Figure 4:
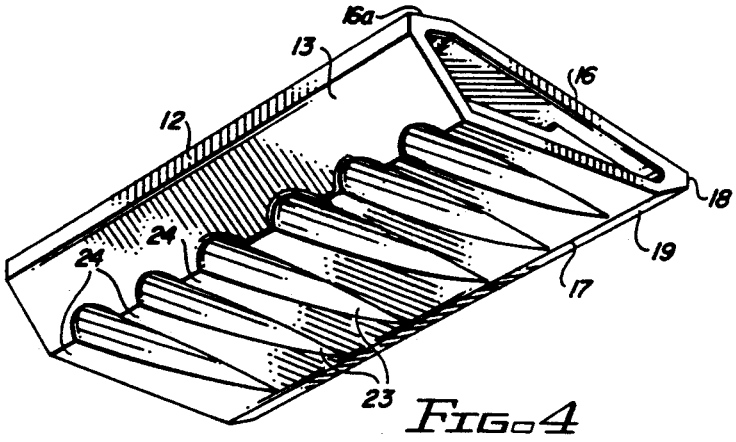
FIG. 4 is a bottom elevational view of the putter head.

The side edge is further shown in FIGS. 3 and 4 with front surface 12, rearward tapered surface 13, socket 14, top surface 16, flattened front edge 16*a*, rear edge 18, and rear tapered surface 19 as described. The front striking surface may if desired have a slight rearward taper of say 3–6 degrees as shown in dotted lines at 12*a*. This appears to contribute toward counter clockwise rotation of the ball on contact therewith.

FIG. 4 is an isometric view of the bottom of the club head which more particularly illustrates the provision of spaced longitudinal grooves formed in the bottom to provide a series of flat support surfaces which also act as runners or guides through the grass area while at the same time serving to provide a flat lie for the club head. The grooves are shown at 23 and result in a series of spaced parallel base contacting supports or runners 24 and provide an effective comb-through or hydroplane effect when drawn back and forth through grassy areas. While shown as tapered, in a preferred form the grooves may be uniform and continuous from front to back to produce a similar "comb" effect. The dimension and number of grooves and runners can be varied as long as a suitable combing effect can be obtained. In the figure as shown there are six grooves each gradually tapering from about $\frac{3}{8}''$–$\frac{1}{8}''$ in width, the depth of the groove also tapering from $\frac{1}{4}''$ deep at the front to zero at the rear, this contributes to the desired comb and sled or hydroplane effect upon movement through the grass.

Figure 5:
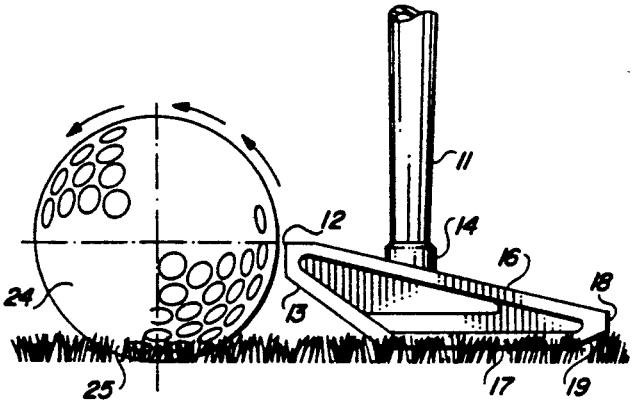
FIG. 5 is a side view in perspective showing the putter in operational position to a ball on a fringe area around the green.

FIG. 5 shows the club head in its address position to the ball resting on the grass 25 of the fringe area. The front face 12 is positioned at and below the central horizontal axis of the ball as desired. The head rests flat on the grass in its base 17 and the front forward taper 13 and the slight rear taper 19 permits smooth forward and backward movement of the head through the grass.

Figure 6:
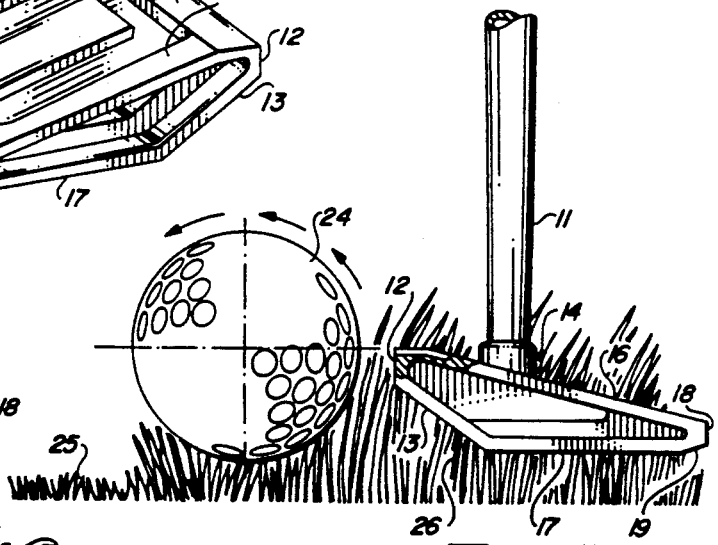
FIG. 6 is a side view in perspective of the putter in operational position to a ball in a higher grass area beyond the fringe area of the green.

In FIG. 6 the ball is shown resting in taller fairway grass at the outer edge of the fringe. The fringe area is shown at 25 and the taller grass area is shown at 26. The putter head is shown addressing the ball with its face 12 in the desired position and with its base 17 comprising the runners and grooves shown in FIG. 4 positioned over the higher grass. In view of the hydroplane or comb effect of the described bottom structure of grooves and ribs or runners, the head can be smoothly moved to address and strike the ball.

In summary therefore, applicant has described a novel putter which has a dual function in that it can be played on the green or in the rough or on or against the fringe because of the unique structure which provides longitudinal runners and grooves on the bottom surface and an upthrust elevated putting face with downward tapers from the front and rear edges allowing the putters to be taken back and through without drag as described above.

The structure of the putting head may best be defined as a rectangular member having a flat base and a forward upward thrusting flat surface terminating in a narrow flat upper edge area which forms the ball engaging surface. Extending rearward from this surface the top of the head tapers downward to the rear edge to the base. The resulting structure may be considered as one having a polyhedral vertical cross section taken from front to back.

I claim:

1. A golf putter especially adapted for dual purpose use both on the putting green and on the fringe or higher grass areas surrounding a green, which comprises a club head having a polyhedral vertical transverse cross section, a rectangular horizontal configuration base surface for engagement with a playing surface, a forwardly upward tapering front surface extending upward from said base terminating in a relatively narrow upwardly extending horizontally elongated ball striking surface defining the upper edge of the club head, a top layer tapering downward from the ball striking surface to the rear edge of said club head, a centrally positioned shaft receiving socket in said top surface spaced from the top edge of said ball striking surface, and a shaft affixed within said socket, said shaft extending directly upward at an angle to the vertical.

2. A golf putter according to claim 1 wherein said flat base surface is formed with a plurality of spaced parallel longitudinally extending grooves from the front of said base surface to the rear thereof, said grooves defining a corresponding number of ridges or runners to facilitate movement through grass of a greater height than that on the surface of a putting green.

3. A golf putter according to claim 2 wherein the downwardly tapering top surface is provided with an open socket area centrally of its rear edge to accommodate a golf ball when slidably positioned thereunder.

4. A golf putter according to claim 1 wherein said shaft extends upward and toward the player at an angle to the vertical of about 18–24 degrees.

5. A golf putter head especially adapted to putting in a grass area which comprises:

(a) a rectangular body, (b) said body having a flat base portion, (c) An upward and forward extending flat portion tapering angularly to a flat generally vertical ball engaging area coextensive therewith across the top front of said body at a height sufficient to engage said ball at or below its horizontal axis, (d) A top surface portion tapering downward from said ball engaging area to the rear edge of said body, (e) A centrally positioned socket on said top surface adapted to engage the end of a club shaft, (f) said shaft extending upward at an angle to the vertical in alignment with said putting surface and toward the player.

6. A golf putter head according to claim 5 wherein said flat base portion is formed with a plurality of spaced parallel longitudinal grooves extending from the front of said base to the rear thereof said grooves defining a plurality of correspondingly spaced runners which cooperate with said grooves in facilitating froward and backward movement through grass having a height greater than that of a putting green.

7. A golf putter according to claim 5, wherein the ball engaging area has a slight rearward taper.

* * * * *